US006685514B2

(12) United States Patent
Costa

(10) Patent No.: US 6,685,514 B2
(45) Date of Patent: Feb. 3, 2004

(54) FOLDING BLADE ELECTRICAL TERMINAL

(76) Inventor: Larry J. Costa, 55613 Currant Rd., Mishawaka, IN (US) 46545

( * ) Notice: Subject to any disclaimer, the term of this patent is extended or adjusted under 35 U.S.C. 154(b) by 0 days.

(21) Appl. No.: 10/117,962

(22) Filed: Apr. 5, 2002

(65) Prior Publication Data

US 2003/0190846 A1 Oct. 9, 2003

(51) Int. Cl.[7] ..... H01R 4/10
(52) U.S. Cl. ..... 439/876; 156/276
(58) Field of Search ..... 439/845, 876, 439/874, 849, 850; 156/276

(56) References Cited

U.S. PATENT DOCUMENTS

| | | | | | |
|---|---|---|---|---|---|
| 1,706,412 | A | * | 3/1929 | Roberts | 439/874 |
| 2,540,037 | A | * | 1/1951 | Vough et al. | 439/850 |
| 2,709,211 | A | * | 5/1955 | Glynn | 338/308 |
| 2,787,693 | A | * | 4/1957 | Razlag | 439/80 |
| 3,139,318 | A | * | 6/1964 | Binder et al. | 439/850 |
| 3,989,346 | A | * | 11/1976 | Manning | 439/593 |
| 4,246,467 | A | | 1/1981 | Boaz | 219/522 |
| 4,415,221 | A | * | 11/1983 | Inoue et al. | 439/849 |
| 4,518,138 | A | * | 5/1985 | Stutenkemper et al. | 248/73 |
| 4,540,233 | A | * | 9/1985 | Saijo et al. | 439/834 |
| 4,696,530 | A | * | 9/1987 | Vandame | 439/266 |
| 4,934,966 | A | * | 6/1990 | D'Urso | 439/849 |
| 5,897,406 | A | * | 4/1999 | Benes et al. | 439/859 |
| 5,928,455 | A | * | 7/1999 | Dizin et al. | 156/276 |
| 6,267,630 | B1 | | 7/2001 | Machado | 439/876 |
| 6,406,337 | B1 | * | 6/2002 | Machado | 439/876 |

* cited by examiner

*Primary Examiner*—Tho D. Ta
*Assistant Examiner*—Larisa Tsukerman
(74) *Attorney, Agent, or Firm*—Thomte, Mazour & Niebergall; Shane M. Niebergall

(57) ABSTRACT

The folding blade terminal of the present invention includes a planar base and elongated terminal blade that are operatively connected through an upward projection fold feature and terminal blade angle hinge feature. In use, the folding blade terminal facilitates point-of-use final terminal forming and integral mechanical pull testing while producing a uniform solder fillet around the perimeter of the terminal base, eliminating the risk of stress points caused by irregular solder fillets. Alternate embodiments of the invention provide a terminal lock disposed at the opposite end of the terminal to prevent the unintentional removal of a box terminal from the terminal blade. Another embodiment of the invention provides a double folding blade terminal. Each of the embodiments of the present invention can be formed to have particular profile heights as required.

30 Claims, 11 Drawing Sheets

FOLDING BLADE ELECTRICAL TERMINAL

BACKGROUND OF THE INVENTION

1. Field of the Invention

This present invention relates to blade-style electrical terminals and more particularly to a folding blade electrical terminal that facilitates final terminal folding and integral mechanical pull testing while providing a uniform solder fillet when mechanically connected to a work surface.

2. Description of the Prior Art

Electrical terminals must be connected to certain articles of manufacture to allow for the flow of electricity from one medium to a different medium. This is particularly true in instances where the conductive elements are embedded in a non-conductive material, such as glass or dielectric substrate. In, for instance, automotive glass panels having electrical wiring embedded therein for the purpose of defogging the window, electrical terminals must be attached to the glass panels to provide a point of connection for electrical current input and output.

Blade-style terminals are frequently employed in applications requiring the supply of electrical current to conductive elements embedded in non-conductive substrates. For example, when providing electrical current to a defrosting grid on an automotive glass panel, conductive paint is applied to the interior glass surface in a pattern that defines the desired electrical circuit. The blade terminals are then soldered to the heating grid. A lead wire is then connected to the blade terminal using an inexpensive industry-standard box-style terminal which is typically crimped or soldered to the end of the lead wire. Once the box terminal is slid over the blade terminal, the electrical connection is completed. One disadvantage of such a box-style terminal is that it can be accidentally disconnected from the blade terminal. Attempts have been made to cover box terminals with plastic housings having a latch to engage the blade terminal in an effort to prevent the accidental disengagement of the box terminals from the blade terminals. The use of such plastic housings, however, increase the overall height of the assembled terminal connection such that it is unacceptable in many industry applications.

The blade style of terminal has been developed in several design variations to accommodate specific installations. One such variation employs a U-shaped footprint. These terminals have a base having a pair of elongated symmetrical feet that extend outwardly from a center section in a parallel fashion to form a U-shape. The blade typically extends upwardly from the center section at a desired angle relative to the base. This design is further modified through the use of an optional reinforcing "rib" that is formed in the center of the terminal blade, extending upwardly along the lower portion of the blade. The rib is used to facilitate mechanical pull testing of the terminal's connection to the work surface without changing the blade's angle. The disadvantage in using the rib feature is that the terminal blade cannot be bent after the soldering and pull testing steps for final assembly without fracturing the soldered connection. Without the reinforcing rib detail, the terminal blade can be pressed downward to an appropriate angle for final assembly. However, without the rib detail, the terminal cannot be pull-tested to verify the strength of the solder joint without the terminal blade bending and causing the solder joint to fracture.

Another variation of the blade terminal is provided with a narrow "inline" footprint, which is formed by two individual solder pads at the opposite ends of the terminal that are connected to one another by a raised bridge portion. The raised bridge and individual solder pads accommodate the differential of thermal expansion between the base material and the terminal, which would typically weaken the solder joint. However, the inline terminal cannot be pull-tested to verify the strength of the solder joint without bending the bridge portion and causing the solder joint to fracture.

Another disadvantage with either the U-shaped or inline designs is that the pre-clad solder material on their lower surfaces reflows when the terminal is soldered. The solder then typically cools, having formed an irregular solder fillet between the terminal base and the upward projection structure such as the terminal blade or bridge portion. The irregular fillet creates concentrated stress points on the work surface, which is unacceptable in the industry.

Accordingly, what is needed is a blade terminal that facilitates point-of-use final terminal forming and integral mechanical pull testing while having a uniform solder fillet around the base of the terminal.

SUMMARY OF THE INVENTION

The folding blade electrical terminal of the present invention is provided with a uniform planar base that, when soldered to a working surface, creates a uniform solder fillet around the base's perimeter. A terminal blade is operatively connected to one end of the base through an upward projection fold feature and a terminal blade angle hinge feature. These features allow for point-of-use final terminal forming, variable blade angle positioning for assembly, and final assembly angle-setting once the terminal is soldered to the work surface. The terminal blade is formed to receive an industry-standard box-style terminal to complete an electrical connection.

In an alternate embodiment, the folding blade electrical terminal of the present invention is further provided with an interlock that extends upwardly from the base at the opposite end from the terminal blade. Once the box terminal has been secured to the terminal blade and the terminal blade has been folded adjacent the base, the interlock prevents the box terminal from unintentionally sliding off the terminal blade. Other embodiments of the present invention include an optional second terminal blade, and embodiments having varied profile heights.

It is therefore a principal object of the invention to provide a blade terminal that facilitates point-of-use final forming and integral mechanical pull testing while providing a uniform solder fillet around the terminal's footprint.

Yet another object of the invention is to provide a blade terminal that allows for variable blade angles for assembly.

Still another object of the present invention is to provide a blade terminal that allows for final assembly angle-setting after soldering.

Yet another object of the present invention is to provide a folding blade terminal having an interlock to prevent the unintentional removal of a box terminal that is secured to the terminal blade.

Still another object of the invention is to provide a folding blade terminal that can be formed with a variable profile height.

Yet another object of the present invention is to provide a folding blade terminal that is formed to receive a low profile interlocking cover piece to prevent the unintentional disengagement of a lead wire from the interlock.

These and other objects will be apparent to those skilled in the art.

DESCRIPTION OF THE PREFERRED EMBODIMENT

Figure 1:
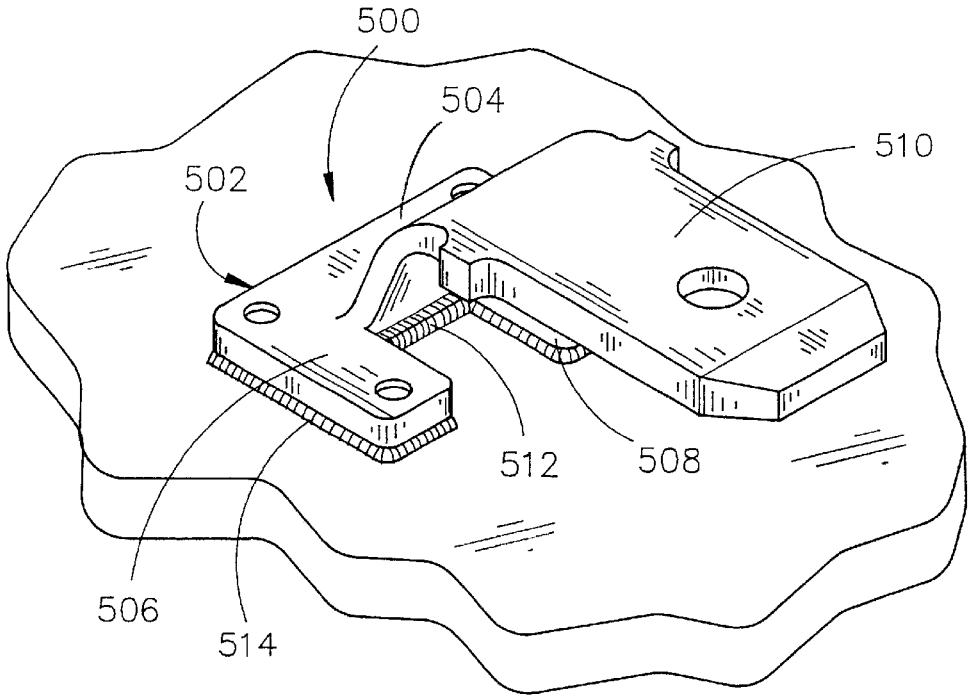
FIG. 1 (PRIOR ART)
FIG. 1 is a perspective view of a prior art blade terminal having a U-shaped footprint after the same has been soldered to a work surface.

FIG. 1 depicts a prior art U-shaped blade terminal 500 having a base 502 comprising a center section 504 and a pair of elongated feet 506 and 508 extending outward from center exterior section 504. A pre-clad solder layer (not shown) is applied to the lower surface of base 502 prior to forming the U-shaped blade terminal 500. The terminal blade 510 is formed by displacing the material between the symmetrical feet 506 and 508. Accordingly, the terminal blade 510 has a portion of the pre-clad solder layer, which was applied to the base 502, disposed along part of its lower surface. In different embodiments, prior art U-shaped terminal 500 may have a reinforcing rib detail (not shown) adjacent the center exterior section 504 and the lower portion of the upper surface of terminal blade 510 to prevent the terminal blade 510 from being deflected.

During a soldering operation, the pre-clad solder layer on the bottom of base 502 and terminal blade 510 flows to the work surface on which the terminal is being connected. This forms a solder fillet 512 adjacent the center interior section 504 between the terminal blade 510 and the symmetrical feet 506 and 508. FIG. 1 illustrates that the solder fillet 512 will typically be much larger than the solder fillet 514 that is formed adjacent the perimeter of the remaining portions of base 502. The lack of uniformity between the solder fillets creates an unacceptable stress point on the work surface, which increases the likelihood of a fracture in the work surface beneath the point of connection.

If the terminal blade 510 is deflected after soldering during a pull strength test or a final assembly positioning of a box terminal, the higher solder fillet 512 will fracture where it is soldered to the work surface. This fracture will be visible from the exterior of glass work surfaces, which is not acceptable in the industry.

Figure 2:
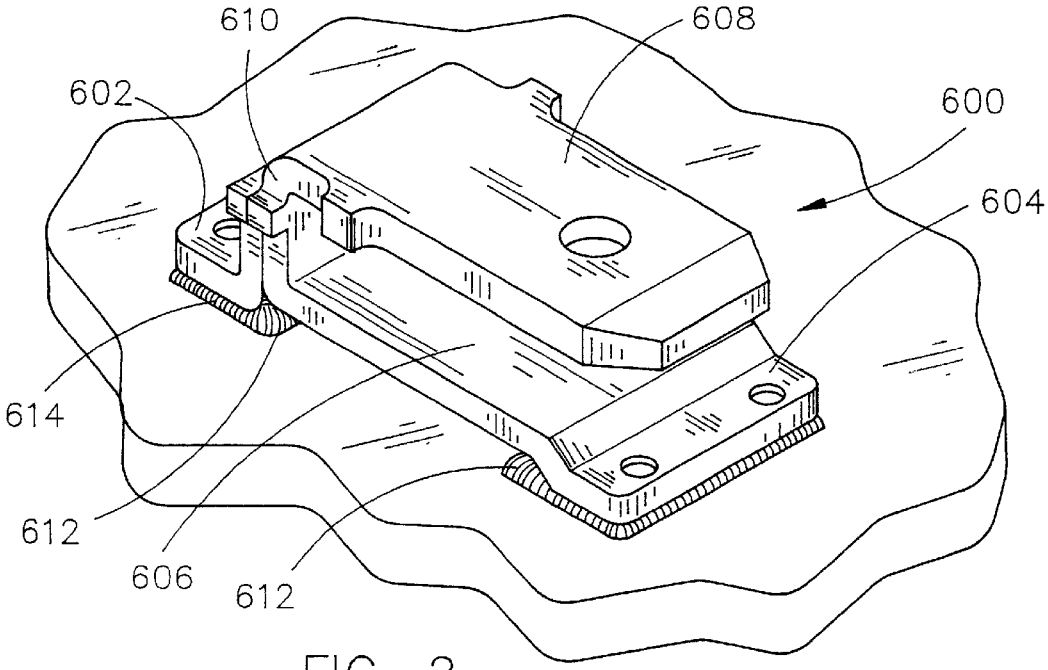
FIG. 2 (PRIOR ART)
FIG. 2 is a perspective view of a prior art inline blade terminal after the same has been soldered to a work surface.

FIG. 2 depicts a prior art inline blade terminal 600 having two base pads 602 and 604, positioned at opposite ends of a raised bridge section 606. A pre-clad solder layer (not shown) is applied to the bottom surface of base pads 602 and 604 and across the bottom surface of the raised bridge section 606 prior to forming the terminal. The terminal blade 608 is formed by displacing the material adjacent to the solder pads 602 and 604 and raised bridge section 606 in an upward manner. The terminal blade 608 is hingedly coupled to the raised bridge section 606 by hinge feature 610. During a soldering operation, the pre-clad solder layer on the bottom surface of raised bridge section 606 flows from the terminal to the work surface. A solder fillet 612 is formed adjacent the bridge section 606 and the two solder base pads 602 and 604. The solder fillet 612 is much larger than the solder fillets 614, which extend along the remainder of the outside perimeter of the two base pads 602 and 604, as shown in FIG. 2. The lack of uniformity between the solder fillets creates undesirable stress points on the work surface that increase the likelihood of fractures in the solder joint and the work surface.

The terminal blade 608 cannot be used for pull strength testing due to the flexible nature of the hinge feature 610. Rather, the raised bridge section 606 must be used during such testing. The disadvantage in using the raised bridge section 606 is that it becomes a fulcrum when used for pull testing between the two solder pads 602 and 604, causing a fracture where solder pads 602 and 604 are soldered to the work surface. This fracture is visible from the exterior of glass work surfaces and is not acceptable in the industry.

Figure 3:
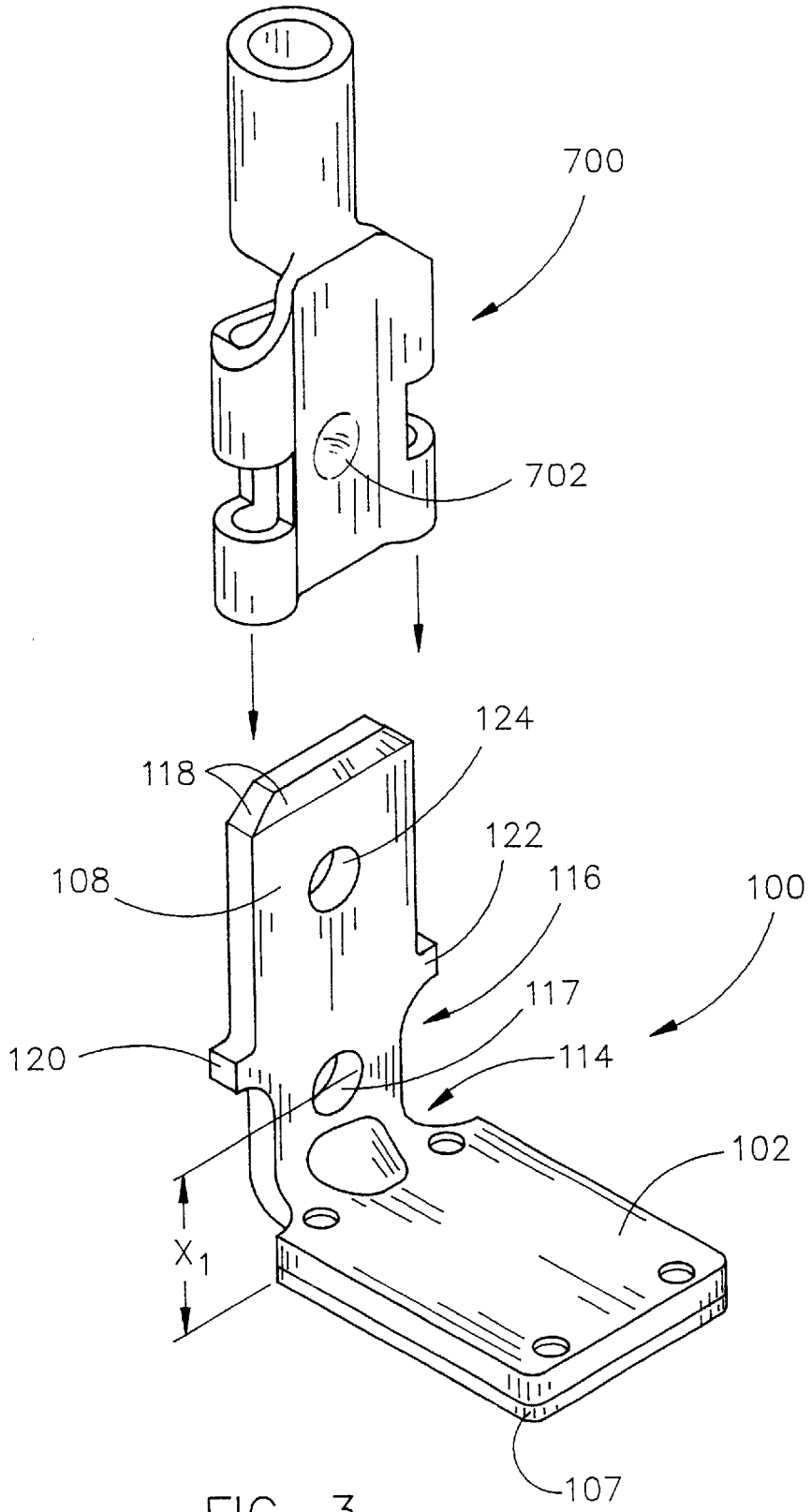
FIG. 3 is a perspective view of the folding blade terminal of the present invention.
Figure 4:
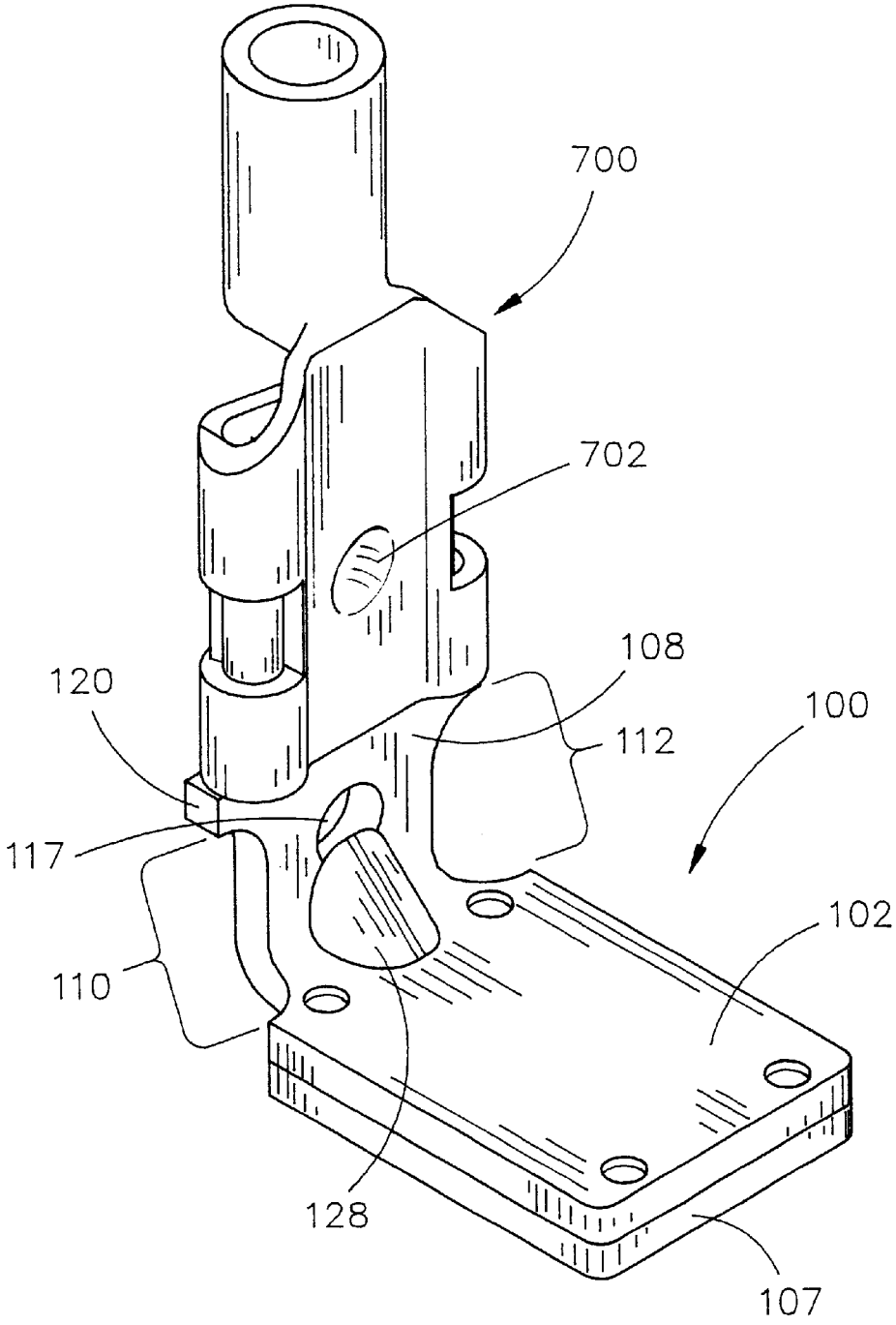
FIG. 4 is a perspective view of the folding blade terminal of the present invention illustrating one manner in which the blade of the terminal receives a prior art box terminal.
Figure 5:
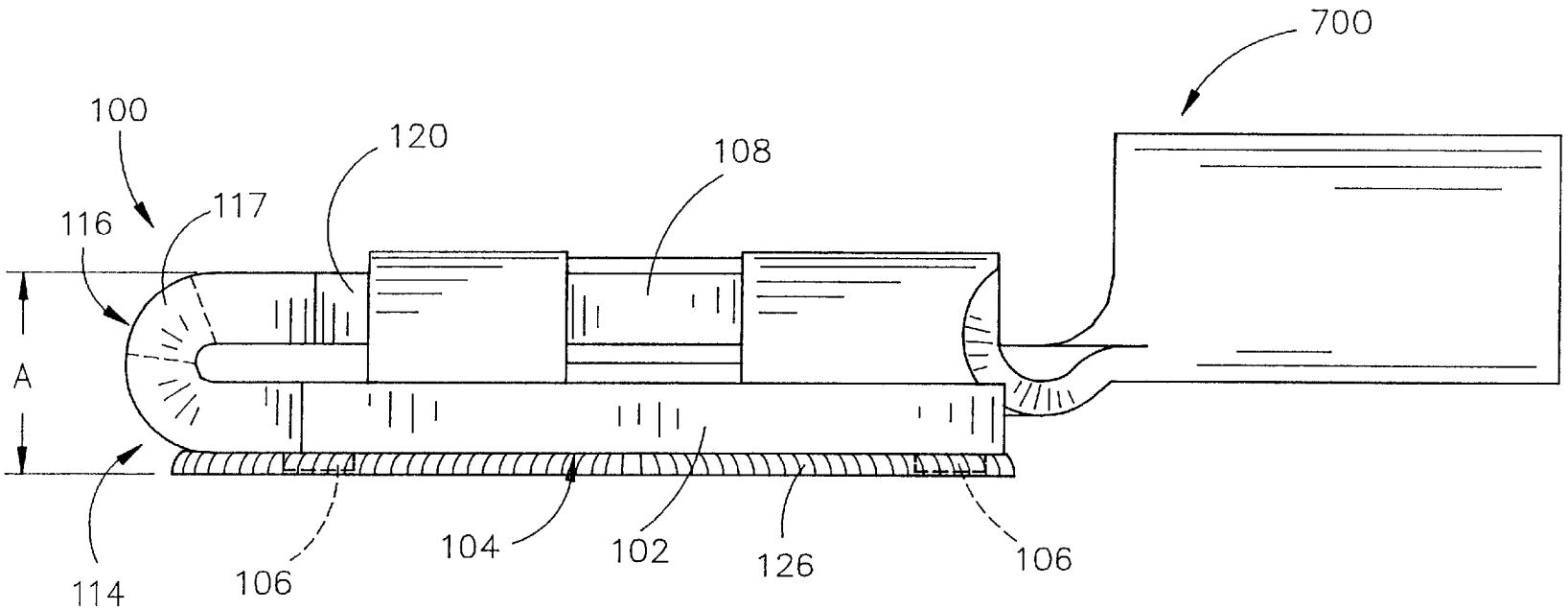
FIG. 5 is a side elevation view of the folding blade terminal of the present invention in a final assembly angle-setting connected to a prior art box terminal.

FIGS. 3 through 5 depict the folding blade terminal 100 of the present invention. Terminal 100 is provided with a planar base 102, having a bottom surface 104 with multiple projections 106 extending downwardly a predetermined distance from bottom surface 104. Projections 106 define a minimum thickness that the solder joint will achieve during the soldering process in a manner similar to that taught in U.S. Pat. No. 4,246,467. A pre-clad solder layer 107 is applied to the bottom surface 104. However, the terminal 100 can also be secured to work surfaces using a wire feed solder system or materials other than solder, such as various types of conductive adhesive.

Figure 12:
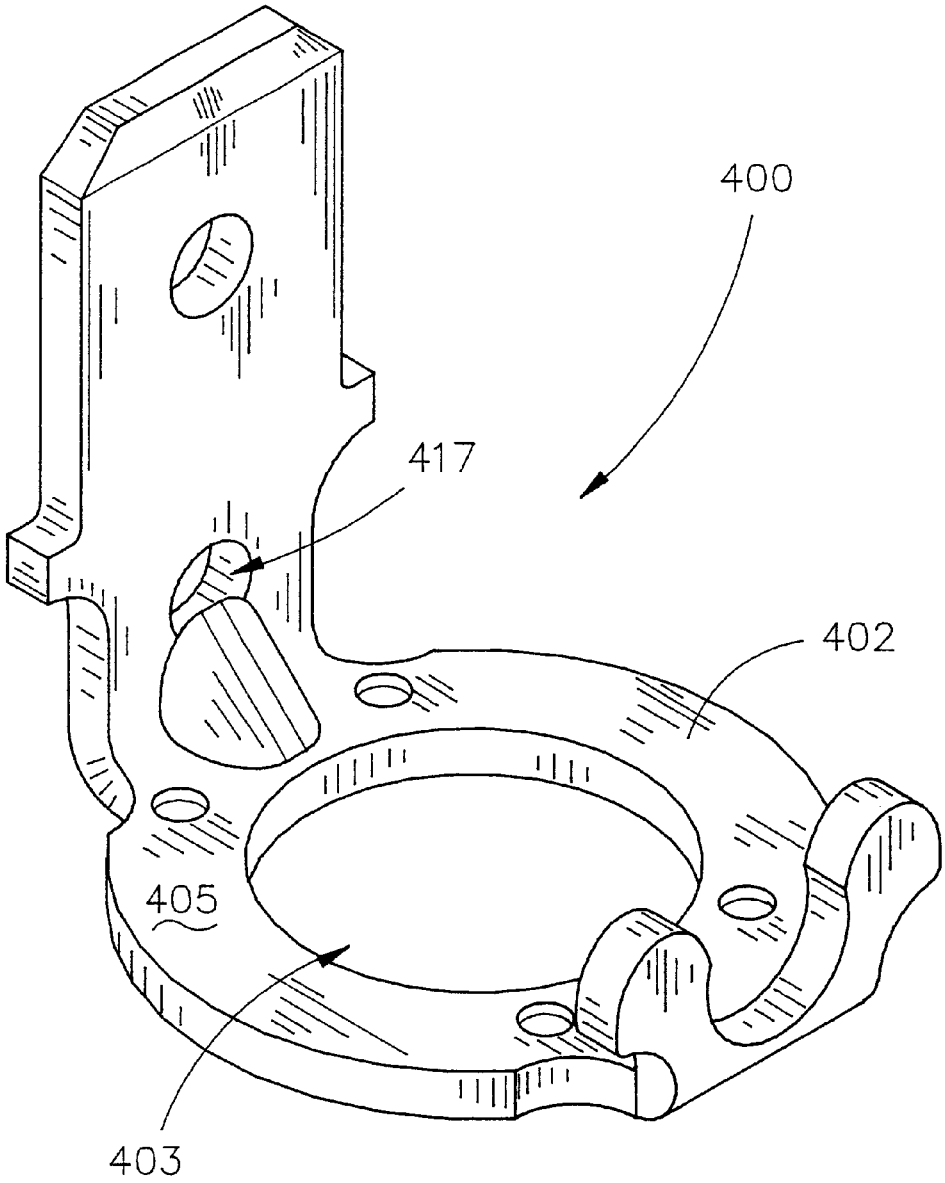
FIG. 12 is a front perspective view of an alternate embodiment of the folding blade terminal of the present invention.

FIG. 3 depicts the base 102 of the terminal 100 as having a generally square or rectangular shape. In an alternate embodiment, shown in FIG. 12, the terminal blade 400 is shown with a base 402 having a circular or generally rounded shape. When it is necessary, a base having a rounded shape can be used to increase the amount of electrical current dissipated by the terminal. While the U-shaped footprint of terminal 500 provides a large peripheral edge that will dissipate an increased amount of electrical current, the rounded base 402 will dissipate an increased amount of electrical current without forming hot spots adjacent its base 402. The U-shape of the base 502 will form a hot spot between the elongated feet 506 and 508, which is undesirable.

The base 402 has been further modified with an optional opening 403 formed therethrough. The opening 403 allows the base 402 to exert less stress on the work surface it is connected to during moments of thermal expansion where a work surface such as glass will have a different coefficient of thermal expansion than the base 402. The opening 403 allows for the thermal expansion of base 402 regardless of the difference in the coefficient of thermal expansion between the base 402 and the work surface. Since the base 402 is allowed to expand and contract more freely, less stress is placed on the connection and the work surface. Additionally, the opening 403 creates two identical parallel electrical currents for electrical resistance soldering of the terminal 400. The parallel circuits are created when a pair of soldering electrodes contact the upper surface 405 of the base 402 180 degrees from each other, relative to the center line of opening 403.

In FIGS. 3 through 5, the rearward end of the base 102 is provided with a terminal blade 108 having a pair symmetrical indentations 110 and 112 that form an upward projection fold feature 114 and a terminal blade angle hinge feature 116. Preferably, the terminal blade angle hinge feature 116 is accompanied by an opening 117, which is positioned intermediate the indentations 110 and 112 in terminal blade 108. By reducing the amount of material between the indentations 110 and 112 at a select location along the terminal blade 108, the terminal blade angle hinge can be more accurately located to provide a desired terminal profile height. While the material between the indentations 110 and 112 can be reduced by increasing the size of the indentations 110 and 112 or providing the opening 117 it is also contemplated that the thickness of the material at that point could be reduced. For example, crimping, compressing, or removing portions of the material along either or both surfaces of the blade 108 will create a reduced thickness. This reduced thickness will form an upward projection fold feature 114.

Rib detail 128 can be optionally formed in terminal 100 along the projection fold feature 114, extending from the base 102 to the terminal blade 108. The rib detail can be formed to work in conjunction with the terminal blade angle hinge feature 116 and opening 117 to locate a terminal blade angle hinge and form a larger bend radius and profile height.

When a pre-clad solder layer is applied to the bottom surface 104, it is preferred that terminal blade 108 be kept free of solder to help prevent the formation of uneven solder fillets. Terminal blade 108 is shaped to have chamfer features 118 formed in its outer edge, which facilitate its insertion into a box terminal 700. Adjacent to the symmetrical indentations 110 and 112 is a pair of symmetrical projection tabs 120 and 122 that extend outwardly from the blade angle hinge feature 116, providing a positive stop for box terminal 700 as shown in FIG. 4. A hole 124 in the center of terminal blade 108 engages a projection 702 on box terminal 700 to secure it in place after it has been inserted onto terminal blade 108.

As the terminal 100 is soldered to the work surface, the solder will flow between the bottom surface 104 of the base 102 and the work surface. A uniform solder fillet 126 will form along the perimeter of the base 102. No irregular solder fillets will form along the structure of base 102, thus eliminating the potential for stress points along the connection point. After the soldering phase, the strength of the solder joint can be subjected to a pull strength test, which can be achieved by symmetrically gripping tabs 120 and 122 on terminal blade 108 and applying the appropriate amount of upward pulling force. Thereafter, terminal blade 108 can be bent along the blade angle hinge feature 116 to facilitate its insertion into a box terminal 700. Finally, the terminal blade 108 is bent into its final assembly position adjacent the base 102, as shown in FIG. 5.

In an alternate embodiment, shown in FIGS. 6, 7, and 9 through 11, a folding blade electrical terminal 200 is provided with a planar base 202, having a bottom surface 204 with a plurality of projections 206 extending downwardly therefrom. As with projections 106, discussed previously, projections 206 define a minimum thickness that the solder joint will achieve during the soldering process in a manner similar to that taught in U.S. Pat. No. 4,246,467. A pre-clad solder layer 207 is applied to the bottom surface 204. However, the terminal 200 can also be secured to work surfaces using a wire feed solder system or materials other than solder, such as various types of conductive adhesive.

The rearward end of the base 202 is provided with a terminal blade 208 which is similar to terminal blade 108 in structure and function. Terminal blade 208 is provided with a pair of indentations 210 and 212 that form upward projection fold feature 214 and a terminal blade angle hinge feature 216. The terminal blade angle hinge feature 216 is optionally provided with an opening 217 to more easily and accurately locate the terminal blade angle hinge in terminal blade 208. Rib detail 228 can be optionally formed in terminal 200 along the projection fold feature 214, extending from the base 202 to the terminal blade 208. The rib detail 228 can be formed to work in conjunction with the terminal blade angle feature 216 and opening 217 to locate a terminal blade angle hinge and form a larger bend radius and profile height.

When a pre-clad solder layer is applied to the bottom surface 204, it is preferred that terminal blade 208 be kept free of solder to help prevent the formation of uneven solder fillets. Chamfer features 218 are formed into the leading edge of terminal blade 208. Projection tabs 220 and 222 extend outwardly from the blade angle hinge feature 216 to provide a positive stop for box terminal 700. An opening 224, formed in the center of terminal blade 108, engages projection 702 on the box terminal 700 to secure it in place.

The forward end of base 202 is provided with an interlock 230, which extends upwardly therefrom. The interlock 230 is provided with a pair of symmetrical indentations 232 and 234 that form an upward projection fold feature 236 and tabs 238 and 240. A cutout 242 in interlock 230 provides clearance for the box terminal 700 after terminal blade 208 has been secured in its final assembly angle setting. In this position, tabs 238 and 240 engage the lower end of box terminal 700 and prevent it from being removed from terminal blade 208. Opposing inner tab portions 244 and 246 of cutout 242 are formed to engage the round crimp feature 704 that secures lead wire 706 to box terminal 700.

As the terminal 200 is soldered to the work surface, the solder will flow between the lower surface 204 of base 202 and the work surface in a manner similar to that exhibited with terminal 100. As the solder cools, a uniform solder fillet 226 will be formed along the perimeter of the base 202. As with terminal 100, no structure is provided adjacent the perimeter of base 202, along which solder will flow from and form a solder fillet larger than solder fillet 226. Accordingly, the potential for the formation of a stress point at the solder joint is eliminated due to the lack of irregular solder fillets.

Once the terminal 200 has been soldered to the work surface, the strength of the solder joint can be tested. A pull strength test is applied to terminal 200 by uniformly and symmetrically gripping tabs 238 and 240 on interlock 230 and tabs 220 and 222 on terminal blade 208 and applying an appropriate amount of upward force. The ability to uniformly and symmetrically grip the terminal 200 by tabs 238, 240, 220 and 222 minimizes the possible deflection of base 202 and fracturing of the solder joint.

After the soldering and pull test phases, the terminal blade 208 can be deflected downwardly toward base 202 via the blade angle hinge feature 216 to facilitate insertion of the terminal blade 208 into box terminal 700. The terminal blade 208 and box terminal 700 are then bent into their final assembly position adjacent base 202, with the box terminal 700 being retained via the interlock tab features 238 and 240. Opposing inner tabs 244 and 246 of cutout 242 engage the crimp feature 704 of box terminal 700 which, in combination of the aforementioned structural features, prevents the terminal blade 208 from raising upward and further prevents box terminal 700 from sliding off terminal blade 208.

Figure 6:
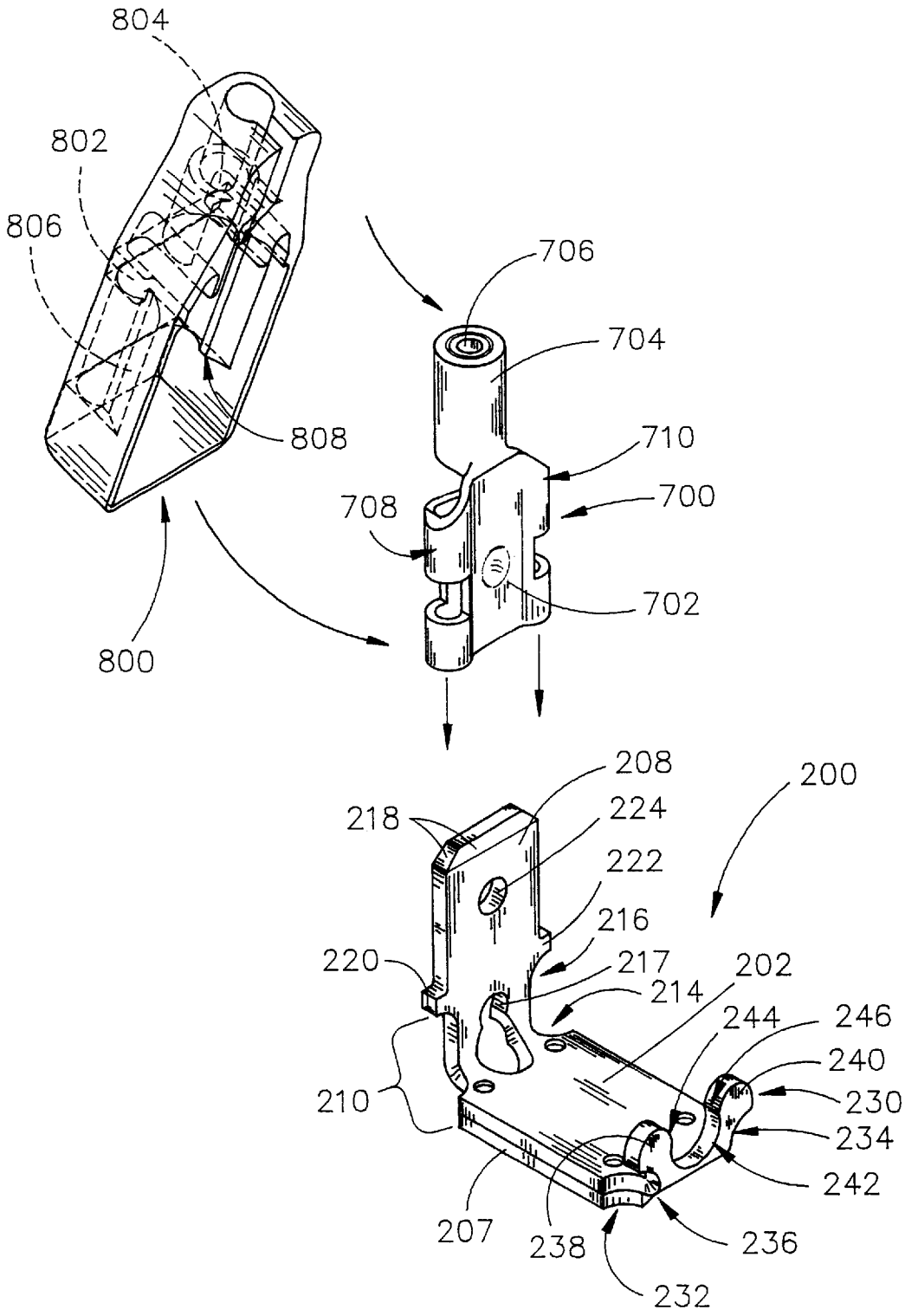
FIG. 6 is a perspective view of an alternate embodiment of the folding blade terminal of the present invention.
Figure 7:
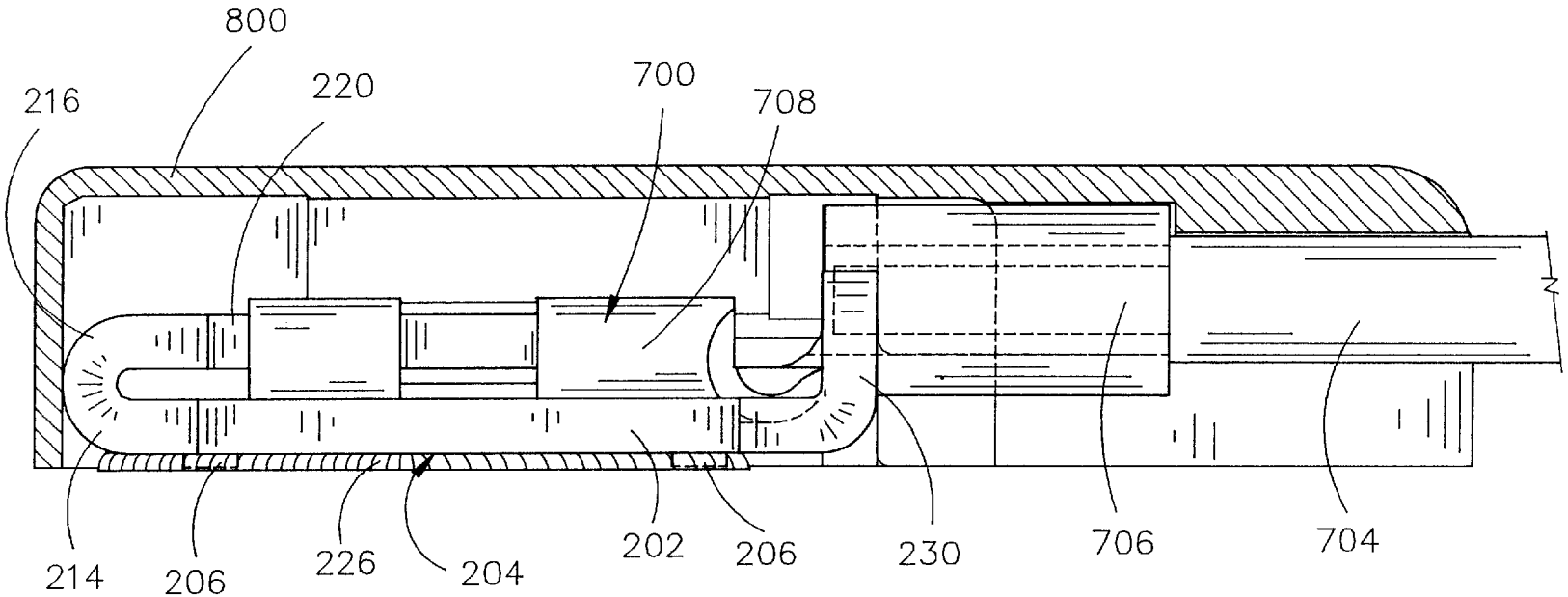
FIG. 7 is a side elevation view of the folding blade terminal of FIG. 6, shown coupled with a prior art box terminal.

FIGS. 6 and 7 depict an insulating cover 800 that is secured around terminal 200 and box terminal 700 in their final assembly setting. The insulating cover 800 is retained by tabs 238 and 240 on interlock 230 and an opposing set of internal gripper details 802 and 804. Features 806 and 808 engage the blade gripping features 708 and 710 on the box terminal 700. The insulating cover 800 retains the terminal blade 208 in its assembled position and further relieves stress placed on lead wire 706.

Figure 8:
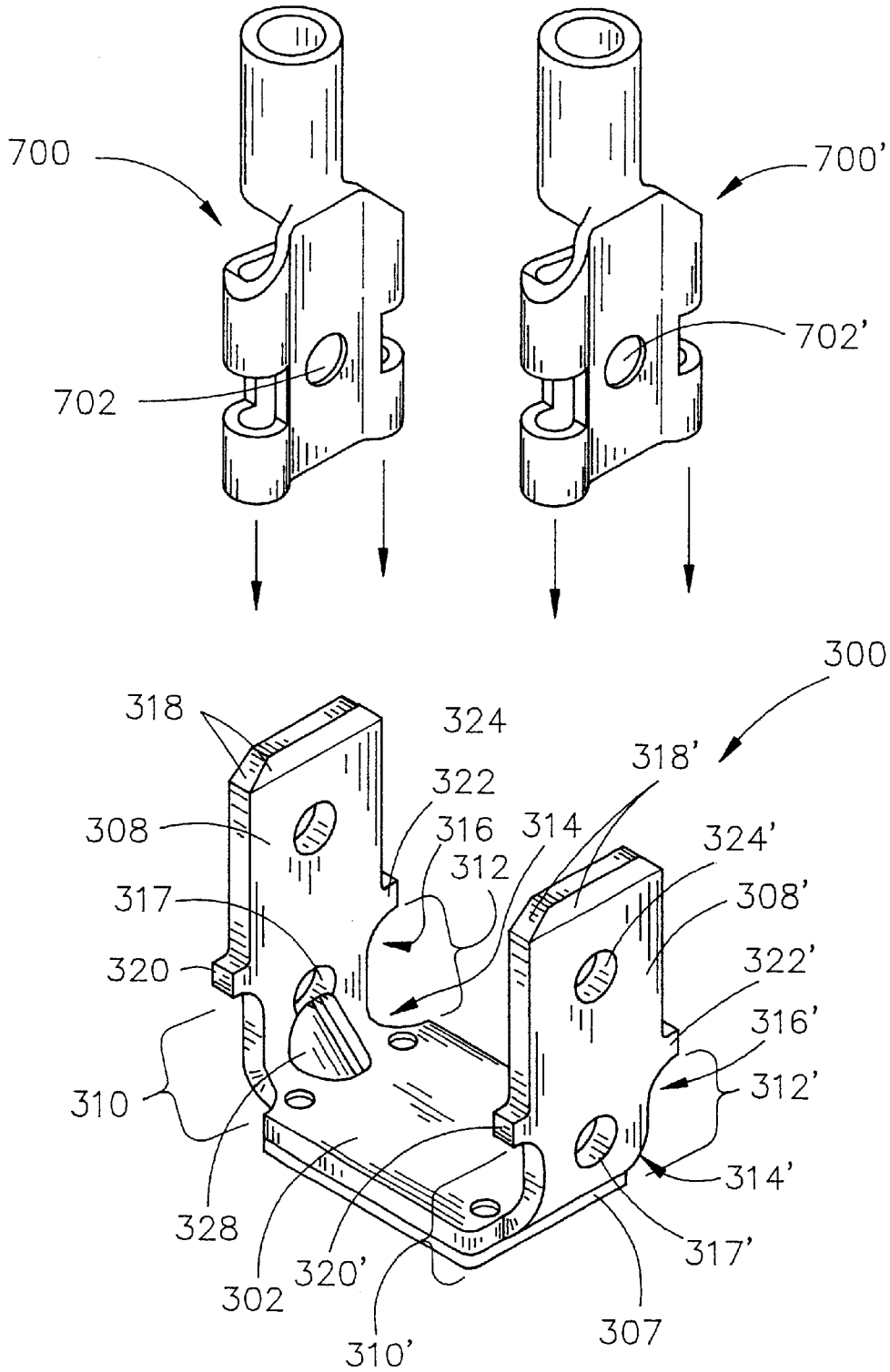
FIG. 8 is a perspective view of an alternate embodiment of the folding blade terminal of FIG. 3.

In another embodiment, shown in FIG. 8, a dual folding blade terminal 300 is provided with a planar base 302 having a bottom surface 304 with a plurality of projections 306 extending downwardly a particular distance from the bottom surface 304 to define a minimum thickness that the solder joint will achieve during the soldering process in a manner similar to that taught in U.S. Pat. No. 4,246,467. A pre-clad solder layer 307 is applied to the bottom surface 304. However, the terminal 300 can also be secured to work surfaces using a wire feed solder system or materials other than solder, such as various types of conductive adhesive. The rearward end of base 302 is provided with a terminal blade 308 that is similar in structure and function to terminal blades 108 and 208. Terminal blade 308 is comprised of a pair of symmetrical indentations 310 and 312 that provide an upward projection fold feature 314 and a terminal blade angle hinge feature 316.

The terminal blade angle hinge feature 316 is optionally accompanied by an opening 317 to more easily and accurately locate the terminal blade angle hinge in terminal blade 308. As with terminals 100 and 200, terminal 300 can be selectively provided with a reinforcing rib detail 328 that extends upwardly from base 302 along projection fold feature 314 and connecting to the lower portion of terminal blade 308. Rib detail 328 is formed into terminal 300 to work alone or in conjunction with terminal blade angle hinge feature 316 and opening 317 to locate a terminal blade angle hinge and form a larger bend radius and profile height.

Chamfer features 318 are formed into the leading edge of terminal blade 308 to facilitate its insertion into box terminal 700. A pair of symmetrical projection tabs 320 and 322 extend outwardly from the blade angle hinge feature 316, providing a positive stop for box terminal 700. An opening 324 is formed in the center of terminal blade 308 to engage projection 702 on box terminal 700 to secure it in place.

The forward end of base 302 is provided with a terminal blade 308' which is similar to terminal blade 308 in structure and function. Terminal blade 308' is shown in FIG. 8 having a pair of symmetrical indentations 310' and 312' that form upward projection fold feature 314' and a terminal blade angle hinge feature 116'. Opening 317' is optionally provided to more accurately and easily locate the terminal blade angle hinge in terminal blade 308'. The upper edge of terminal blade 308' is provided with chamfer features 318' to receive a second box terminal 700'. Symmetrical projection tabs 320' and 322' provide a positive stop for the second box terminal 700', and opening 324' is provided to engage a projection 702' on the second box terminal 700'.

When a pre-clad solder layer is applied to the bottom surface 304, it is preferred that the terminal blades 308 and 308' be kept free of solder to help prevent the formation of uneven solder fillets. As terminal blade 300 is soldered to a work surface, the aforedescribed structure will function similarly to that found in terminals 100 and 200 in that the solder will flow between the lower surface 304 of base 302 and the work surface, forming a uniform solder fillet around the perimeter of base 302. The uniform solder fillet eliminates the risk of stress points caused by irregular solder fillets found in the prior art. After the soldering phase, the strength of the newly tested solder joint can be subjected to a pull strength test by uniformly and symmetrically gripping tab features 320 and 322 on terminal blade 308 and tabs 320' and 322' on terminal blade 308' and applying an upward pulling force. The uniform manner in which forces are exerted on the solder joint minimizes the deflection of base 802, reducing the risk of solder joint fractures.

After the solder and pull test phases, the terminal blades 308 and 308' can be deflected downwardly via the blade angle hinge features 316 and 316' to facilitate their insertion into box terminals. The terminal blades 316 and 316' are then bent into their final assembly positions. Depending on the application, it is contemplated that the terminal blades 308 and 308' may both be bent away from base 302, both be left extending perpendicularly from base 302, or one positioned adjacent base 304 and the other either positioned perpendicular to or away from base 302.

The insulating cover 800, shown in FIGS. 6 and 7, can be easily secured around terminal 300 and box terminal 700 in a final assembly setting. Features 806 and 808 engage the blade gripping features 708 and 710 on the box terminal 700. Accordingly, the insulating cover 800 can be used to cover either the terminal blade 308 or the terminal blade 308'. A second insulating cover 800 can be used when an application requires separate covering of both terminal blades. The insulating cover 800 can also be enlarged to simultaneously cover both terminal blades.

Figure 9:
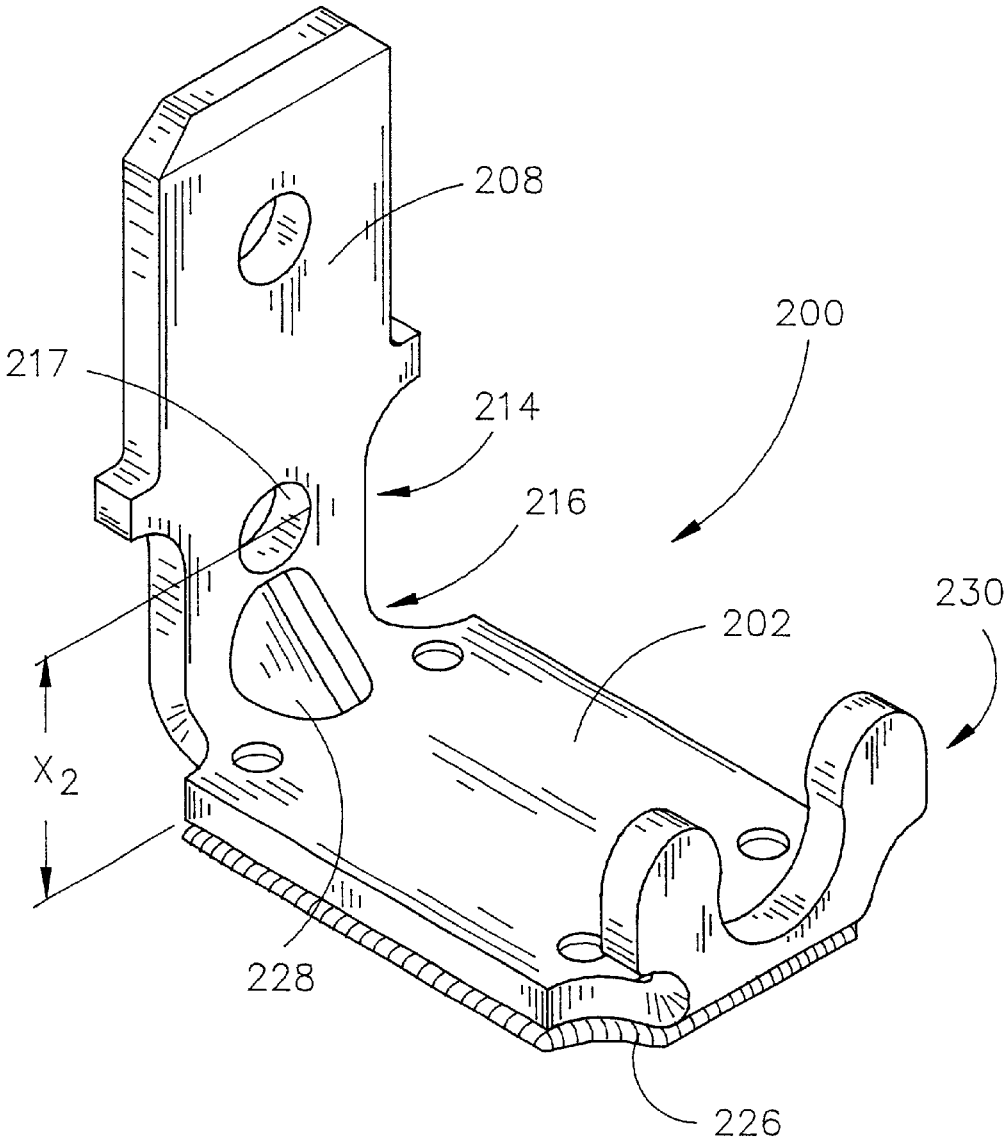
FIG. 9 is a perspective view of an alternate embodiment of the folding blade terminal of FIG. 6 having a large bend radius and increased profile height.
Figure 10:
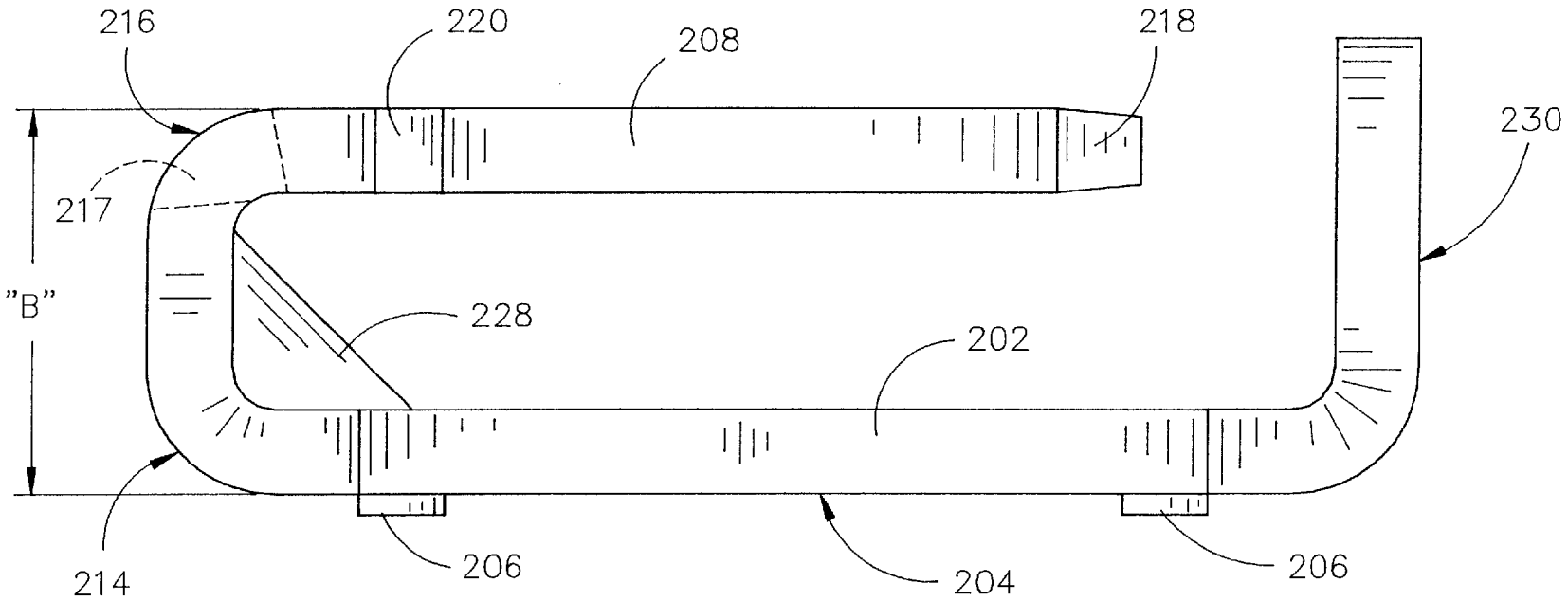
FIG. 10 is a side elevation view of the folding blade terminal of FIG. 9 in a final assembly angle-setting.
Figure 11:
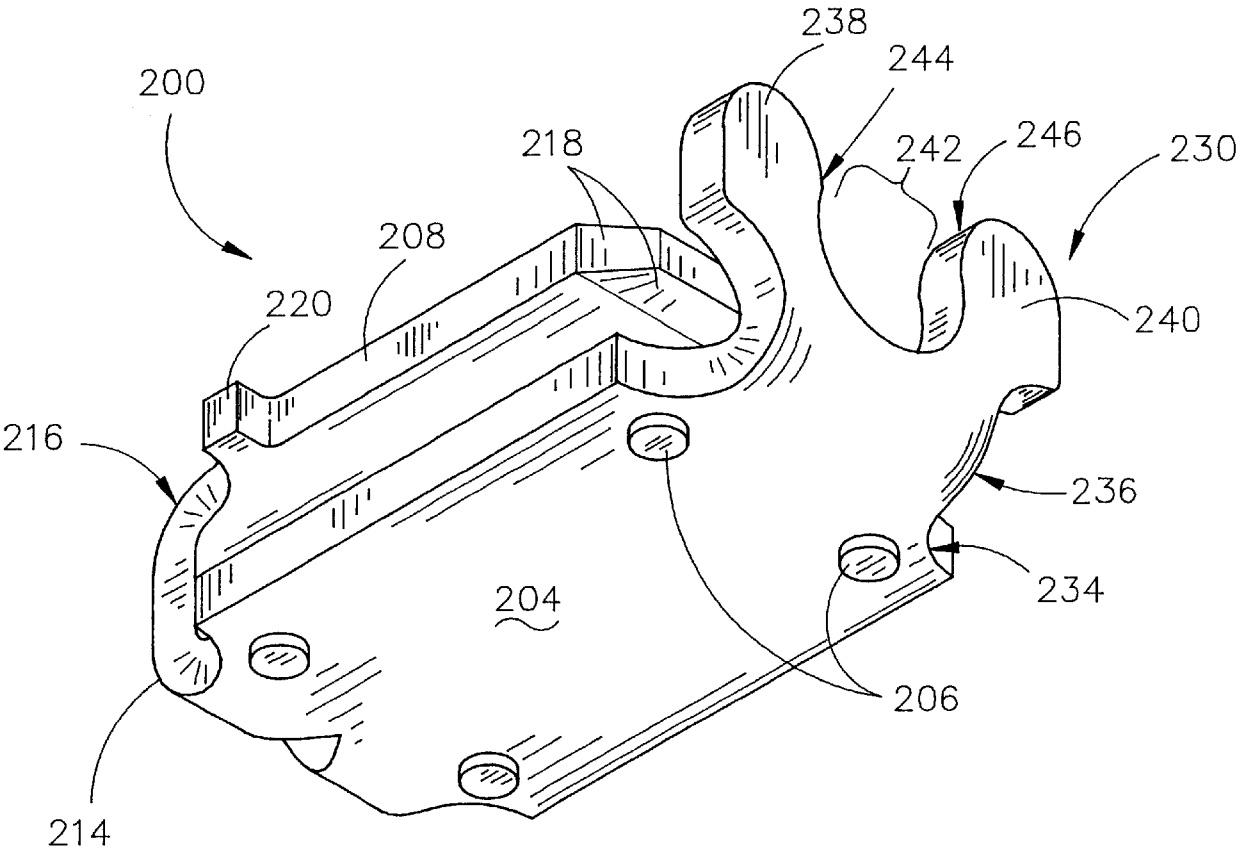
FIG. 11 is a bottom perspective view of the folding blade terminal of FIG. 6.

Each of folding blade terminals 100, 200, 300 and 400 will have a particular profile height, measured from the work surface to the highest point of the terminal blade when it is set in its final assembly angle setting. The height of the profile achieved by each terminal is determined in part by the positioning of the terminal blade angle hinge opening 117, 217, 317 and 417 along their respective terminal blades a specified distance from upward projection fold features 114, 214, 314 and 414, respectively. For example, FIG. 3 illustrates folding blade terminal 100, having a terminal blade angle hinge opening 117 that is positioned a short distance "$X_1$" from upward projection fold feature 114. This position provides for a small bend radius and shortened profile height "A", shown in FIG. 5. Alternatively, FIG. 9 depicts a folding blade terminal 200 having terminal blade angle opening 217 that is formed in terminal blade 208 a distance "$X_2$'" from upward projection fold feature 214, which is greater than distance "$X_1$" by a chosen distance $\Delta X$. This change in separation distance between the upward projection fold feature and the terminal blade angle hinge feature translates into an increased profile height "B", shown in FIG. 10, which is greater than profile height "A" by a distance of $\Delta X$.

Where an increase in profile height is desired, a rib detail 228 can be selectively formed to extend from the base 202, along upward projection fold feature 214, to terminal blade 208, as shown in FIG. 9. The rib detail 228 will resist deflection of terminal blade 208 below the point it connects with terminal blade 208. Accordingly, the greater the profile height desired, the higher the rib detail 228 should connect with terminal blade 208. Rib detail can be used alone or in conjunction with the terminal blade angle hinge opening 217, depending on the desired application.

Where a moderate profile height is desired, no terminal blade angle hinge feature opening 217 or rib detail 228 should be provided. Leaving only the upward fold feature 214 intermediate the base 202 and the terminal blade 208, the lower portion of the terminal blade 208 adjacent the upward fold feature 214 will bend downwardly toward base 202 in a tight radius, determined only by the flexibility of the material used to form the terminal.

In the drawings and in the specification, there have been set forth preferred embodiments of the invention; and although specified items are employed, these are used in a generic and descriptive sense only and not for purposes of limitation. Changes in the form and proportion of parts, as well as substitute of equivalents, are contemplated as circumstances may suggest or render expedient without departing from the spirit or scope of the invention as further defined in the following claims.

Thus, it can be seen that the invention accomplishes at least all of its stated objectives.

I claim:

1. A folding blade electrical terminal for connection with a work surface, comprising:

a generally planar base having upper and lower surfaces, a forward end portion, a rearward end portion and a peripheral edge portion;

an elongated blade having upper and lower end portions and opposing side edges;

said lower end portion of said blade being operatively connected to the peripheral edge portion of said base;

a blade angle hinge feature intermediate said base and said blade; said blade angle hinge feature being formed to allow said blade to be selectively bent to a final assembly position with respect to said base; and at least one tab connected to and extending outwardly from said blade; said at least one tab being adapted to facilitate a pull test of the terminal after it has been operatively connected to the work surface.

2. The folding blade electrical terminal of claim 1 further provided with chamfer features formed in the upper end of said blade to facilitate the positioning of said blade within a box terminal.

3. The folding electrical terminal of claim 2 wherein said blade is further provided with an opening formed intermediate the upper and lower ends thereof to releasably secure the box terminal to said blade.

4. The folding blade electrical terminal of claim 1 further comprising an opening formed in said blade adjacent the lower end portion of said blade; said opening and said blade angle feature being positioned with respect to one another and said base to selectively predetermine a profile height for the terminal in its final assembly position.

5. The folding blade electrical terminal of claim 4 further comprising a rib detail intermediate said blade angle hinge feature and said base; said rib detail and said blade angle feature being positioned with respect to one another and said base to selectively predetermine a profile height for the terminal in its final assembly position.

6. The folding blade electrical terminal of claim 4 further comprising a rib detail intermediate said blade angle hinge feature and said base; said rib detail, opening and said blade angle feature being positioned with respect to one another and said base to selectively predetermine a profile height for the terminal in a final assembly position.

7. A folding blade electrical terminal for connection with a work surface, comprising:

a generally planar base having upper and lower surfaces, a forward end portion, a rearward end portion and a peripheral edge portion;

an elongated blade having upper and lower end portions and opposing side edges;

said lower end portion of said blade being operatively connected to the peripheral edge portion of said base;

a blade angle hinge feature intermediate said base and said blade; said blade angle hinge feature being formed to allow said blade to be selectively bent to a final assembly position with respect to said base; and first and second tabs operatively connected to and extending outwardly from the opposing side edges of said blade so that the terminal can be selectively subjected to symmetrical pull test forces.

8. A folding blade electrical terminal for connection with a work surface, comprising:

a generally planar base having upper and lower surfaces, a forward end portion, a rearward end portion and a peripheral edge portion;

an elongated blade having upper and lower end portions and opposing side edges;

said lower end portion of said blade being operatively connected to the peripheral edge portion of said base;

a blade angle hinge feature intermediate said base and said blade; said blade angle hinge feature being formed to allow said blade to be selectively bent to a final assembly position with respect to said base; and an interlock operatively connected to the peripheral edge portion of said base opposite said blade.

9. The folding blade electrical terminal of claim 1 wherein said interlock is shaped to prevent the removal of a box terminal from said blade when said blade is in a final assembly position above said base.

10. The folding blade electrical terminal of claim 1 wherein said interlock is provided with first and second interlock tabs; said first and second tabs being adapted to prevent the unintentional removal of a box terminal from said blade when said blade is in a final assembly position adjacent said interlock above said base.

11. The folding blade electrical terminal of claim 10 wherein said interlock is provided with a recess between said first and second tabs to releasably engage a portion of a box terminal disposed on said blade when said blade is in a final assembly position above said base.

12. The folding blade electrical terminal of claim 10 further comprising first and second tabs operatively connected to the opposing side edges of said blade so that the terminal can be selectively and simultaneously gripped by said first and second blade tabs and said first and second interlock tabs and subjected to symmetrical pull test forces.

13. The folding blade electrical terminal of claim 10 further comprising an insulating cover operatively connected to said blade and said first and second interlock tabs to retain said blade in a final assembly position.

14. The folding blade electrical terminal of claim 1 further comprising an first upward fold intermediate said base and said blade angle hinge feature.

15. The folding blade electrical terminal of claim 14 further comprising an opening formed in said blade adjacent the lower end portion of said blade; said opening and said blade angle feature being positioned with respect to one another and said base to selectively predetermine a profile height for the terminal in its final assembly position.

16. The folding blade electrical terminal of claim 14 further comprising a rib detail intermediate said blade angle hinge feature and said base; said rib detail and said blade angle feature being positioned with respect to one another and said base to selectively predetermine the profile height of the terminal in its final assembly position.

17. The folding blade electrical terminal of claim 15 further comprising a rib detail intermediate said blade angle hinge feature and said base; said rib detail, opening and said blade angle feature being positioned with respect to one another and said base to selectively predetermine a profile height for the terminal in its final assembly position.

18. The folding blade electrical terminal of claim 1 further comprising an opening formed in said blade adjacent the lower end of said blade to facilitate the selective bending of said blade to a final assembly position with respect to said base.

19. The folding blade electrical terminal of claim 1 further comprising a rib detail adjacent the lower end of said blade and said base to facilitate the selective bending of said blade to a final assembly position with respect to said base.

20. A folding blade electrical terminal for connection with a work surface, comprising:

a generally planar base having upper and lower surfaces, a forward end portion, a rearward end portion and a peripheral edge portion;

an elongated blade having upper and lower end portions and opposing side edges; said lower end portion of said blade being operatively connected to the peripheral edge portion of said base;

a blade angle hinge feature intermediate said base and said blade; said blade angle hinge feature being formed to allow said blade to be selectively bent to a final assembly position with respect to said base; and a second elongated blade having upper and lower ends and opposing side edges operatively connected to the forward end of said base.

21. The folding blade electrical terminal of claim 1 further comprising first and second tabs operatively connected to the opposing side edges of said second blade so that the terminal can be selectively and simultaneously gripped by said first and second tabs of said second blade and said first and second tabs of said blade and subjected to symmetrical pull test forces.

22. The folding blade electrical terminal of claim 1 further comprising a second blade angle hinge feature adjacent the lower end of said second blade to facilitate the selective bending of said second blade to a final assembly position with respect to said base.

23. The folding blade electrical terminal of claim 22 further comprising a second rib detail adjacent the lower end of said second blade and said base to facilitate the selective bending of said second blade to a final assembly position with respect to said base.

24. The folding blade electrical terminal of claim 22 further comprising a second opening formed in said second blade adjacent the lower end portion of said second blade; said opening and said second blade angle feature being positioned with respect to one another and said base to selectively predetermine a profile height for the terminal in a final assembly position.

25. The folding blade electrical terminal of claim 22 further comprising a second rib detail adjacent said second blade angle hinge feature and said base; said second rib detail and said second blade angle feature being positioned with respect to one another and said base to selectively predetermine a profile height for the terminal in a final assembly position.

26. The folding blade electrical terminal of claim 24 further comprising a second rib detail intermediate said second blade angle hinge feature and said base; said second rib detail, second opening and second blade angle feature being positioned with respect to one another and said base to selectively predetermine a profile height for the terminal in its final assembly position.

27. The folding blade electrical terminal of claim 1 further comprising a second opening formed in said second blade adjacent the lower end of said second blade to facilitate the selective bending of said second blade to a final assembly position with respect to said base.

28. The folding blade electrical terminal of claim 1 further comprising an insulating cover operatively connected to said blade to retain the blade in a final assembly position.

29. The folding blade electrical terminal of claim 28 further comprising a second insulating cover operatively connected to said second blade to retain the second blade in a final assembly position.

30. The folding blade electrical terminal of claim 1 further comprising an insulating cover operatively connected to said blade and said second blade to retain the blade and the second blade in a final assembly position.

* * * * *